US006158109A

United States Patent [19]

Tanabe et al.

[11] Patent Number: 6,158,109

[45] Date of Patent: Dec. 12, 2000

[54] COIL MANUFACTURING METHOD USING RING SHAPED SPACER

[75] Inventors: Kei Tanabe; Naoki Shimamura, both of Iwaki, Japan

[73] Assignee: Alpine Electronics, Inc., Tokyo, Japan

[21] Appl. No.: 09/014,493

[22] Filed: Jan. 28, 1998

Related U.S. Application Data

[62] Division of application No. 08/620,050, Mar. 20, 1996, Pat. No. 5,937,076.

[51] Int. Cl.[7] ..... H01F 7/06

[52] U.S. Cl. ..... 29/605; 29/606; 381/409; 381/410; 336/171

[58] Field of Search ..... 381/400, 401, 381/402, 409, 410, 195; 29/605, 602.1, 606; 336/171, 181

[56] References Cited

U.S. PATENT DOCUMENTS

| | | | |
|---|---|---|---|
| 1,775,880 | 9/1930 | Whitlock . | |
| 2,727,949 | 12/1955 | Lokkesmoe | 179/115.5 |
| 3,196,211 | 7/1965 | Kessenich | 179/1 |
| 3,686,446 | 8/1972 | Manger | 179/115.5 DV |
| 4,473,811 | 9/1984 | Schauble | 336/171 |
| 4,597,169 | 7/1986 | Chamberlin | 29/605 |
| 4,609,784 | 9/1986 | Miller | 179/115.5 DV |
| 4,783,824 | 11/1988 | Kobayashi | 381/195 |
| 5,214,710 | 5/1993 | Ziegenberg et al. | 381/199 |
| 5,511,131 | 4/1996 | Kohara et al. | 381/192 |
| 5,937,076 | 8/1999 | Tanable et al. | 381/409 |

FOREIGN PATENT DOCUMENTS

| | | | |
|---|---|---|---|
| 1180456 | 6/1959 | France | 381/199 |
| 55-37071 | 3/1980 | Japan | 381/199 |

*Primary Examiner*—Lee Young
*Assistant Examiner*—Minh Trinh
*Attorney, Agent, or Firm*—Brinks Hofer Gilson & Lione

[57] ABSTRACT

A spacer for mounting around the outer peripheral surface of a bobbin. The spacer has first and second edge surfaces formed in a circular arc shape. Subsequent to the formation of a first coil by winding wire around the bobbin, the wire is continuously curved from a distal end portion of the first coil along the first edge surface of the spacer. After making a U-turn of substantially 180 degrees, the wire is wound to form the second coil. Upon completion of winding of the second coil, the wire is guided along the second edge surface, from an end portion of the second coil, and a second portion of the first coil is wound. The portion of the wire for connecting both of the first and second coils is free from bent corners, thus avoiding the generation of stress concentration. Also, the wire is guided by smooth and curved edge surfaces of the spacer, thus preventing damage to a coating on the wire.

5 Claims, 7 Drawing Sheets

COIL MANUFACTURING METHOD USING RING SHAPED SPACER

CROSS-REFERENCE TO RELATED APPLICATION

This application is a divisional of application Ser. No. 08/620,050 filed Mar. 20, 1996, now U.S. Pat. No. 5,937, 076.

BACKGROUND OF THE INVENTION

1. Field of the Invention

The present invention relates to a magnetic drive apparatus for use in, for example, a speaker, the magnetic drive apparatus including a coil wound around a bobbin and a member for generating a magnetic field across the coil. The invention also relates to a method for manufacturing the coil of the magnetic drive apparatus.

2. Description of the Related Art

FIG. 5 is a sectional view showing one-half of a speaker installed in, for example, a vehicle. FIG. 6A is a front view showing a coil (voice coil) C which forms a portion of a magnetic drive apparatus A of the speaker. FIG. 6A also shows a bobbin 3 around which the coil C is wound. FIG. 6B is a top view of the coil C and the bobbin 3 shown in FIG. 6A.

The portion of the magnetic drive apparatus shown in FIG. 6A includes the tubular bobbin 3 which is made from a paper material or a resin-impregnated paper material. The coil C is formed by winding a covered lead wire 4 (round copper wire or flat wire) around the outer peripheral surface of the bobbin 3. The coil C includes a first coil C1 and a second coil C2, the coils C1 and C2 being spaced apart by a distance d along the axis of the bobbin 3. The coils C1 and C2 are wound in opposite directions around the axis of the bobbin 3.

A method will now be explained for winding the lead wire 4 around the bobbin 3, i.e., a method for manufacturing the coil C of the magnetic drive apparatus A.

In the method for winding the wire 4 around the bobbin 3, a spacer S1, which is shown in FIG. 7, is used as an auxiliary member. The spacer S1 is formed of a material which can be slightly deformed, such as a plastic material. The spacer S1 is formed in a ring-like shape having a thickness d measured in an axial direction of the spacer S1. The spacer S1 includes a hole 22 having internal diameter r which is equivalent to or slightly smaller than an outer diameter R of the bobbin 3 (see FIG. 6A). Edge portions 21*a* and 21*b*, which opposedly face each other across a wire-passing portion 21, are formed to have a planar shape which extends along the axial direction (the vertical direction in FIG. 7). The wire passing portion 21 is formed by removing a section of the ring-shaped material forming the spacer S1.

As illustrated in FIG. 6B, the hole 22 of the spacer S1 fits around the outer peripheral surface of the bobbin 3. A piece of wire 4 is then wound around the bobbin 3 adjacent the top surface 23*a* of the spacer S1. The first coil C1 is thus formed. Similarly, the wire 4 is wound around the bobbin 3 adjacent a bottom surface 23*b* of the spacer S1, thus forming the second coil C2.

More specifically, as shown in FIG. 6A, starting from a first leading portion la of the coil, the wire (lead wire) 4 is wound around the outer peripheral surface of the bobbin 3, for example, in the direction α, to form at least one loop, thus forming an inner layer of the first coil C1. At an end portion 1*b* of the first coil C1, the wire 4 is bent substantially perpendicular at the upper corner of the edge portion 21*a* of the spacer S1 such that the wire 4 extends linearly downward along the planar surface of the edge portion 21*a*, and is finally bent perpendicularly at the lower corner of the edge portion 21*a* to form a leading portion 1*c* of the second coil C2. The second coil C2 is wound, for example, in the direction β, which is opposite to the direction in which the first coil C1 is wound. After the wire 4 is wound at a plurality of turns to form the second coil C2, at an end portion 1*d* of the second coil C2 is bent substantially perpendicular at the lower corner of the edge portion 21*b* of the spacer S1 such that the wire 4 extends linearly upward along the planar edge portion 21*b*. The wire 4 is further bent substantially perpendicularly at the upper corner of edge portion 21*b* at a leading portion 1*e* and is wound in the direction α on the inner layer of the coil C1 which has already been formed. When the total number of turns of the first coil C1 is equal to the total number of turns of the second coil C2, the wire 4 is bent upward at an end portion 1*f*.

After the coils C1 and C2 are formed, the spacer S1 is detached from the outer peripheral surface of the bobbin 3. The wire 4 forming the first and second coils C1 and C2 is fixed to the bobbin 3 either by an adhesive, or by a paper material wound around the outer surfaces of the first and second coils C1 and C2. Formation of the coil C is thereby completed.

The speaker shown in FIG. 5 includes a sound-producing cone (diaphragm) 12 mounted within a frame 11. An opening formed in an inner portion 12*b* of the cone 12 is covered with a domed section 13, while an outer edge 12*a* is connected to an opened end 11*a* of the frame 11 by a deformed suspension portion 14 that has a curved semi-cylindrical shape. The edge of the inner portion 12*b* of the cone 12 is supported by the frame 11 using a damper 15. The damper 15, which is formed of, for example, a resin-fiber-braided flexible sheet, a paper material or a resin film, is constructed in the form of a plurality of concentric waves. The cone 12 is vibratably supported on the frame 11 by the above-described suspension portion 14 and the damper 15.

The bobbin 3 is attached to the inner portion 12*b* of the cone 12. A magnetic-field generating member is disposed at the base portion within the frame 11. The magnetic-field generating member includes a magnet 18 and a yoke 17 formed of a highly-permeable material, both components being fixed to the base portion of the frame 11. Gap G1 is formed between the N-pole surface of the magnet 18 and the yoke 17, while gap G2 is formed between the S-pole surface and the yoke 17. The above-described first coil C1 is located within gap G1, while the second coil C2 is positioned within gap G2. A voice current is passed through the wire (lead wire) 4 so as to flow in the first and second coils C1 and C2 in the opposite directions. The bobbin 3 and the cone 12 are vibrated in response to the above-described voice current and magnetic fields generated across the respective first and second coils C1 and C2 located between the magnet 18 and the yoke 17.

In the coil C provided for the above-described magnetic drive apparatus A of the speaker, the first and second coils C1 and C2 are separated by the distance d measured along the axis of the bobbin 3. Connecting portions 4*a* and 4*b* of the wire 4 are connected between the first and second coils C1 and C2. The connecting portion 4*a* is bent perpendicularly at the end portion 1*b* and the leading portion 1*c* adjacent the top and bottom corners, respectively, of the edge portion 21*a* of the spacer S1, as shown in FIG. 6A, thereby disadvantageously connecting the coils C1 and C2 linearly along the planar surface of the edge portion 21*a*.

Similarly, the connecting portion 4*b* is also bent perpendicularly at the end portion 1*d* and the leading portion 1*e* because of the configuration of the edge portion 21*b* of the spacer S1, thus linearly connecting the coils C1 and C2.

Wire 4 is bent perpendicularly at the end portions 1*b* and 1*d* and the leading portions 1*c* and 1*e* in the manner described above, causing the formation of bent corners. Thus, there is an increase in stress in the wire 4 at the bent corners and also a rise in resistance. Consequently, if a high-output voice current is allowed to flow in the coil C, a wire break may occur because of the heat generated at the bent corners. Also, in the manufacturing method, the wire 4 is bent perpendicularly at the top and bottom corners of the edge portions 21*a* and 21*b* of the spacer S1, as shown in FIG. 6A, thus easily causing damage to a coating on the wire at the bent corners and further bringing about an insulation fault. If the bent corners are sharp, more serious damage may be caused, that is, the wire 4 may be broken while it is wound to form a coil.

SUMMARY OF THE INVENTION

Accordingly, in order to solve the problems discussed above, it is an object of the present invention to provide a magnetic drive apparatus in which connecting portions between first and second coils are free from deformed portions, which would otherwise cause a large level of stress or damage to the wire, thus avoiding a wire break at such deformed portions caused by the heat generated by a high output current, and also preventing the occurrence of insulation faults.

It is another object of the present invention to provide a method for manufacturing a magnetic drive apparatus in which wire is guided at the connecting portions between the first and second coils without undergoing a large level of stress or an external force which may cause damage to the coating on the wire.

In order to achieve the above objects, the present invention provides a magnetic drive apparatus comprising: a coil structure wound around the outer peripheral surface of a tubular bobbin; and a magnetic-field generating member for generating a magnetic field across the coil structure, whereby a driving force is axially exerted upon the bobbin through the use of the magnetic field and a current flowing through the coil structure, wherein the coil structure comprises first and second coils formed from a piece of wire and being wound in the directions opposite to each other across a spacing along the axis of the bobbin, a U-shaped connecting portion being provided between the first and second coils for allowing the wire to turn substantially 180 degrees from a distal end portion of the first coil to a leading portion of the second coil without incurring the formation of bent corners. More preferably, the wire is continuously curved in the same direction (the same rotating direction) at the connecting portion, free from the formation of a linear segment.

More specifically, a portion of the wire serves as a connecting portion for bridging between the first and second coils. The connecting portion is bent into a substantially 180 degree U-shape extending from a distal end portion of the first coil, and after making the U-turn, the second coil is wound from a leading portion in the direction opposite to the direction in which the first coil is wound. The U-shaped connecting portion is preferably continuously curved such that it does not include a linear segment, and such that it is formed generally in a circular-arc shape or an in an elliptic shape. The following modification may be made by way of example if the first and second coils are disposed across a comparatively wide spacing along the axis of the bobbin. The wire is curved from the distal end portion of the first coil at 45 degrees generally in a circular-arc shape and further extends substantially linearly along the axis of the bobbin. Then, the wire is continuously curved at 45 degrees generally in an arc shape without incurring the formation of bent corners. Accordingly, by the time the wire reaches the leading portion of the second coil, it has turned at substantially 180 degrees.

Further, the wire from the distal end portion of the second coil may be turned at substantially 180 degrees, free from the formation of bent corners, as discussed above, and may further be wound on an inner layer of the first coil in which the wire has already been wound, thus completing the winding operation of the first coil.

The present invention also provides a method for manufacturing the above magnetic drive apparatus. This method employs a spacer removably attached around the outer peripheral surface of a bobbin, the spacer having a wire-passing portion for connecting top and bottom surfaces of the spacer, wherein at least one of a pair of edge portions opposedly facing each other across the wire-passing portion is formed of a surface free from bent corners. More preferably, the method may employ a spacer having at least one edge portion formed of a surface that is continuously curved without having a linear segment. The spacer is fit around the outer peripheral surface of the bobbin. A first coil is wound around the bobbin adjacent a top surface of the spacer. Wire from a distal end portion of the first coil is turned substantially 180 degrees along the edge portion of the spacer without incurring the formation of bent corners. A second coil is wound around the bobbin adjacent a bottom surface of the spacer.

More specifically, the edge portions of the spacer opposedly facing each other across the wire-passing portion are formed along an arc surface, an elliptic surface, or another type of curved surface, free from the formation of bent corners at which the wire is susceptible to bending. The edge portions of the spacer may include a linear segment extending along the axis of the bobbin, in which case, curved surfaces formed in, or example, an arc shape without having bent corners, are continuously formed on both sides of a linear segment. With the use of the spacer, the wire segments serving as the connecting portion for both of the coils can be deformed while being guided by the edge portions of the spacer, thus making it possible to turn the wire at substantially 180 degrees without forming bent corners.

In the above-described method, the following additional modification should be made if the first coil is produced in such a manner that the wire makes a U-turn after the winding operation of the second coil, and is further wound on the inner layer of the first coil. Namely, both of the edge portions of the spacer are formed as curved projections, whereby both of the portion of the wire from the first coil to the second coil and the portion from the second coil to the first coil are curved without bent corners. Also, a spacer may be laterally fitted around the bobbin, or alternatively, a dividable spacer may be used which is separated upon the completion of the first and second coils and detached from the bobbin.

As has been discussed above, according to the magnetic drive apparatus of the present invention, wire can be guided from a distal end portion of a first coil wound around a bobbin to a leading portion of a second coil, free from the formation of bent corners and linear segments, while being continuously curved in the same direction generally in an arc shape or in an elliptic shape. Alternatively, wire may be curved in a U-shape while partially having a linear segment. The wire can then be continuously wound to form the second coil without incurring the formation of bent corners at the leading portion. The absence of bent corners avoids stress concentrations on the portion of the wire bridging the first and second coils, which would otherwise cause a break in the wire at bent corners and a break due to the heat generated by a high-output current.

According to the manufacturing method of the magnetic drive apparatus of the present invention, a spacer mounted around a bobbin between the first and second coils is constructed in the following fashion. The edge portions of the spacer opposedly facing each other across the wire-passing portion are free from linear segments which cause the formation of bent corners at the wire. More preferably, the edge portions are formed of projections that are continuously curved without having linear segments. Consequently, wire can be guided from one coil to the other coil without incurring the formation of bent corners. More preferably, wire is continuously curved in the same direction. This can protect the wire from a large bending stress caused by bent corners of the spacer and also prevent damage to a coating on the wire, which otherwise cause an insulation fault.

DESCRIPTION OF THE PREFERRED EMBODIMENTS

Figure 1:
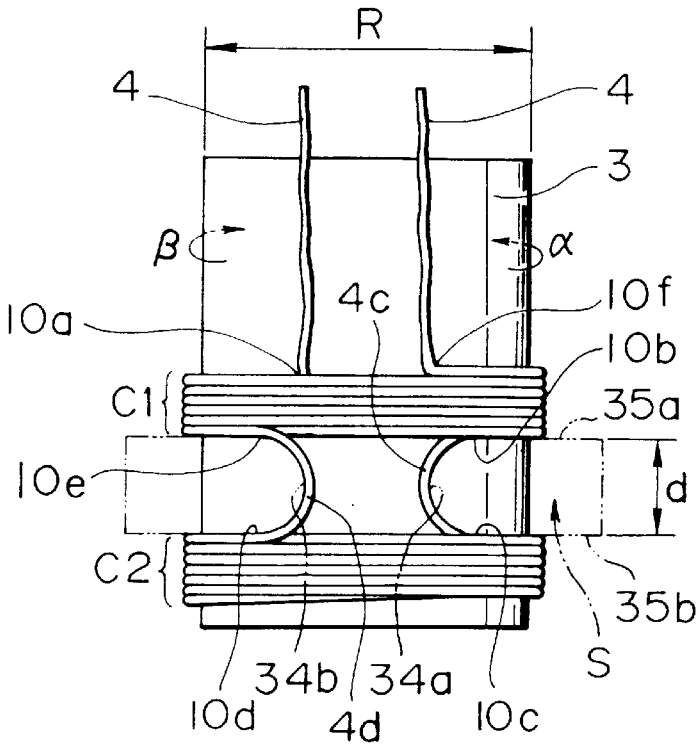
FIG. 1 is a front view of a bobbin and a coil, both of which form a magnetic drive apparatus of the present invention.
Figure 2:
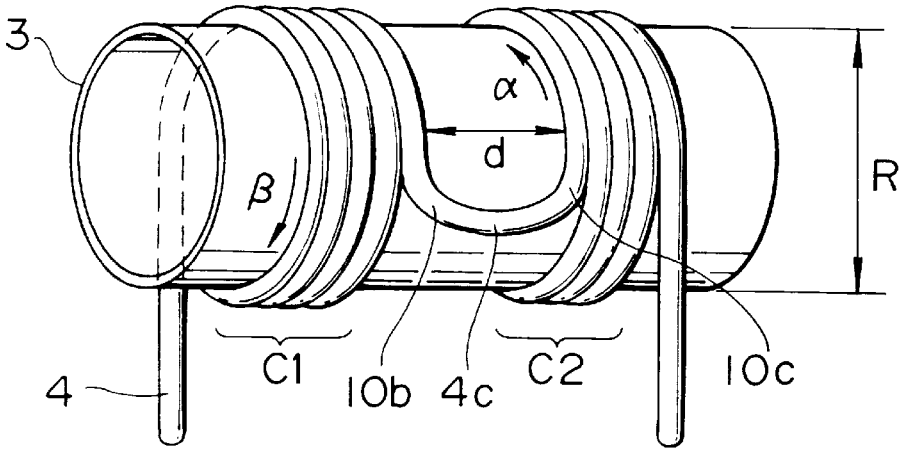
FIG. 2 is a perspective view illustrating a process for producing a coil by winding a wire around the bobbin.
Figure 3:
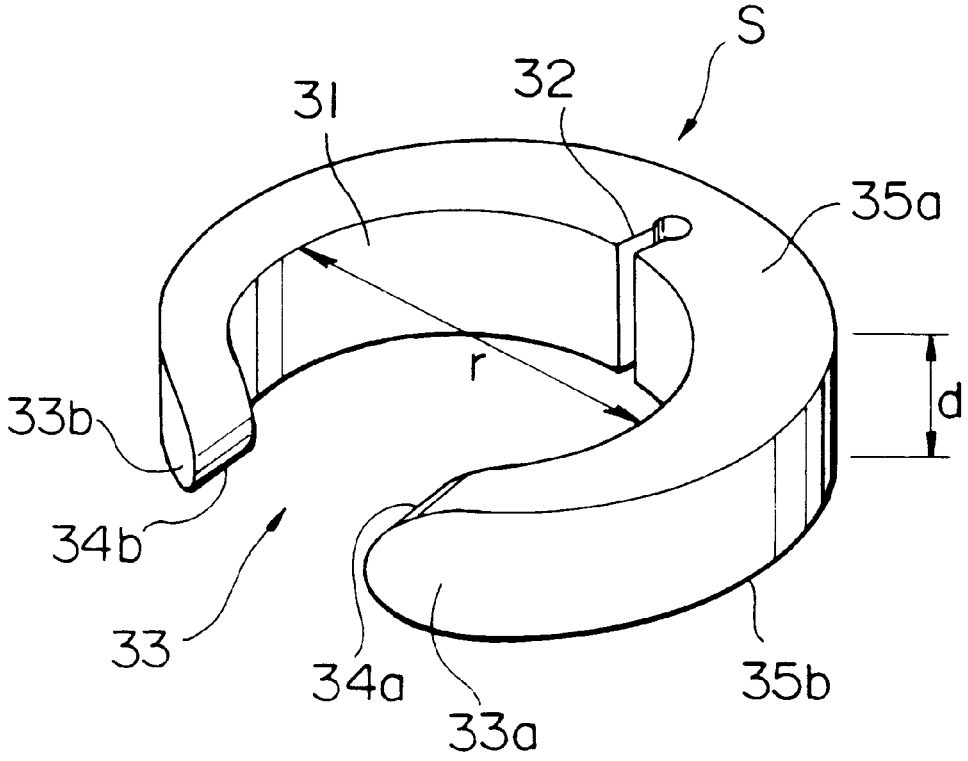
FIG. 3 is a perspective view of a spacer used for coil-winding operation.
Figure 4A:
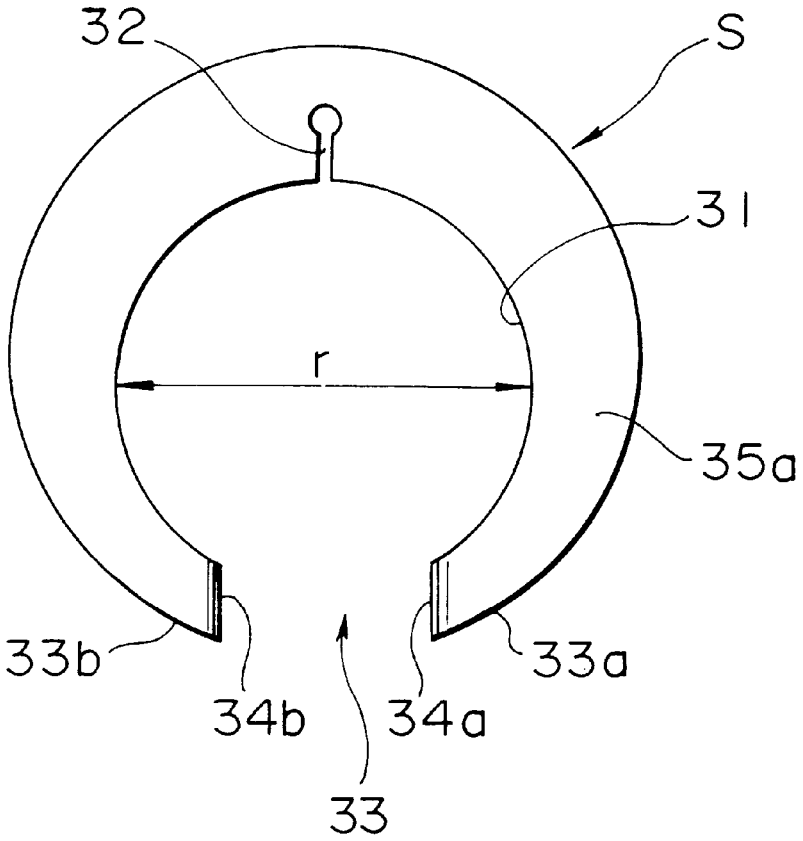
FIG. 4A is a top view of the spacer shown in FIG. 3.
Figure 4B:
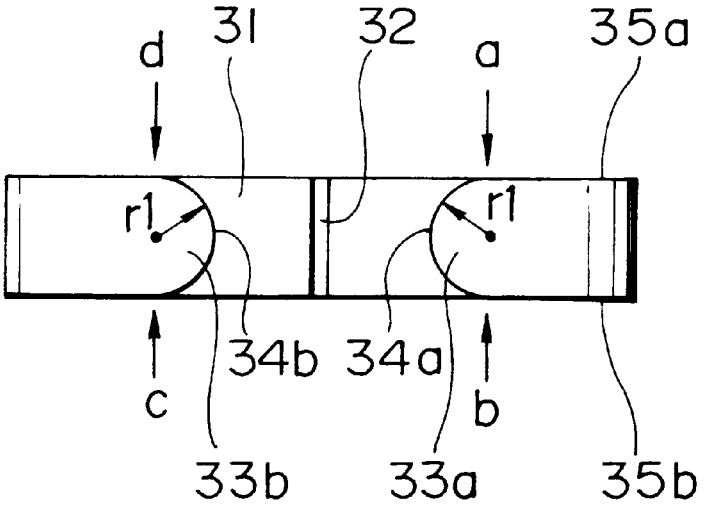
FIG. 4B is a front view of the spacer shown in FIG. 4A.

An embodiment of the present invention will now be described with reference to the drawings. FIG. 1 is a front view of a coil and a bobbin for use in a magnetic drive apparatus according to the present invention. FIG. 2 is a perspective view illustrating the operation of winding wire around the bobbin. FIG. 3 is a perspective view of a spacer for use in a manufacturing method of the magnetic drive apparatus according to the present invention. FIGS. 4A and 4B are a top view and a front view, respectively, of the spacer.

Figure 5:
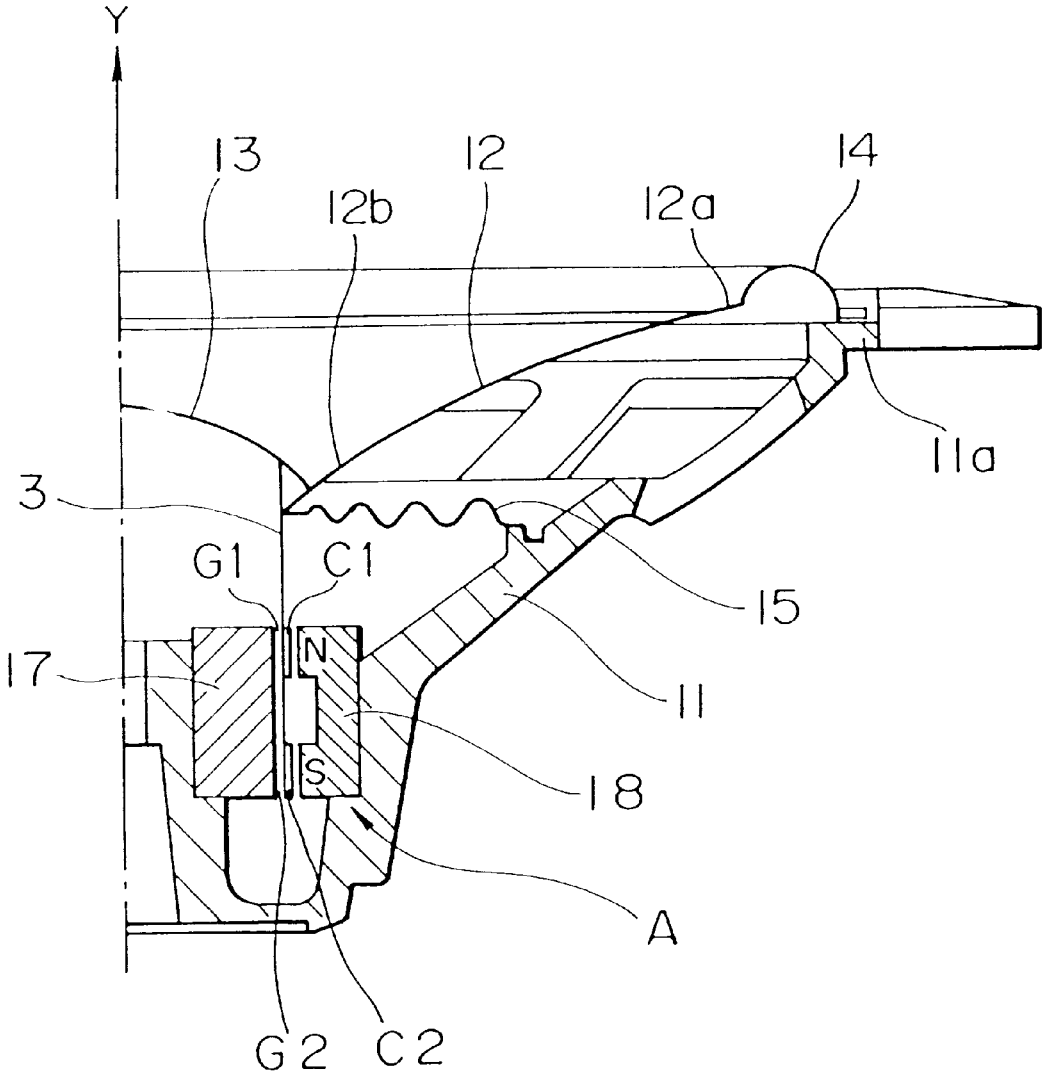
FIG. 5 PRIOR ART
FIG. 5 is a sectional view of one-half of a speaker showing an example of the various embodiments of the magnetic drive apparatus.
Figure 6A:
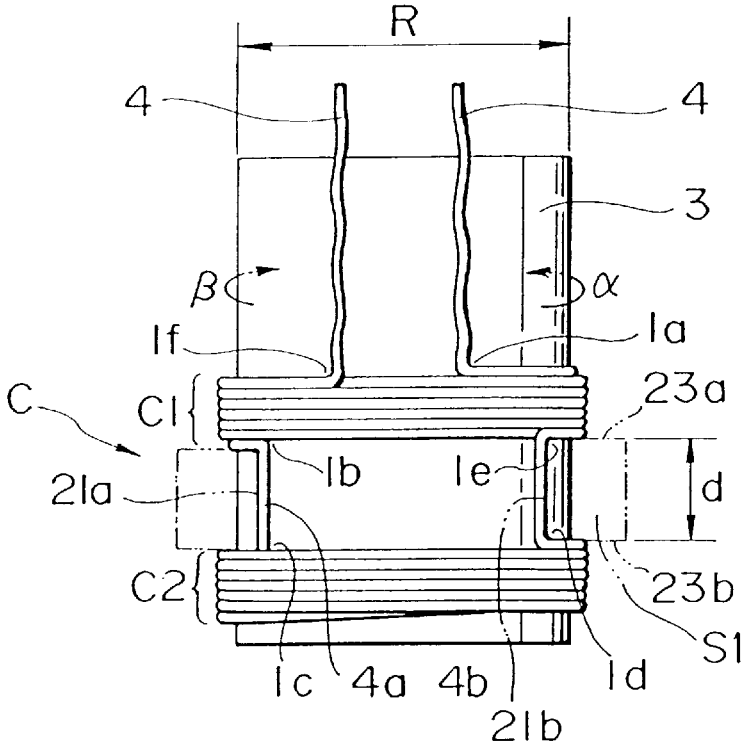
FIG. 6A PRIOR ART
FIG. 6A is a front view of a bobbin and a coil for use in a conventional magnetic drive apparatus.
Figure 6B:
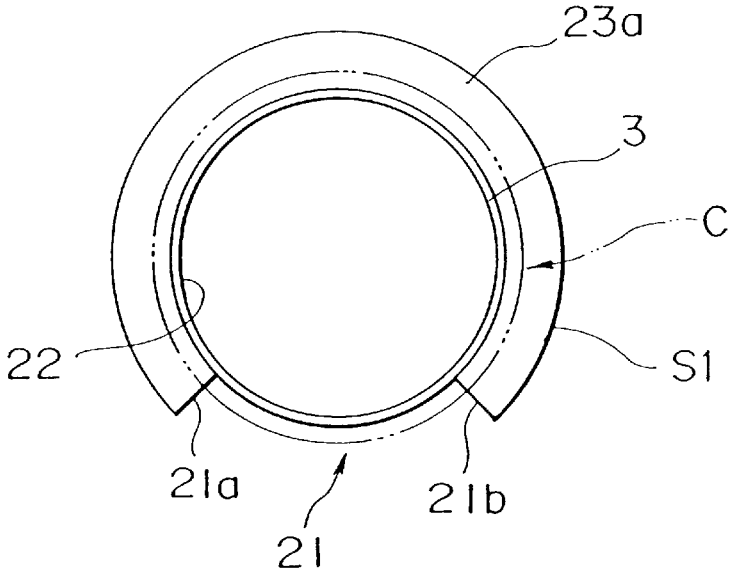
FIG. 6B PRIOR ART
FIG. 6B is a top view of the bobbin and the coil shown in FIG. 6A.
Figure 7:
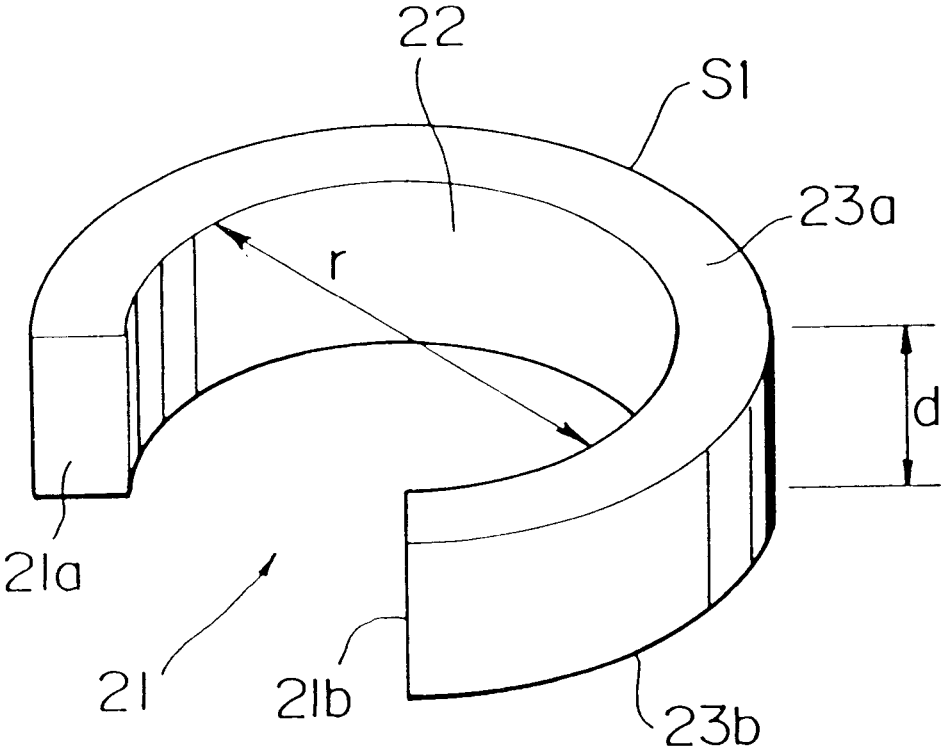
FIG. 7 PRIOR ART
FIG. 7 is a perspective view of a spacer employed for the winding operation of the coil illustrated in FIGS. 6A and 6B.

A magnetic drive apparatus generally denoted by A of the present invention is used in, for example, a speaker similar to the speaker shown in FIG. 5. In the magnetic drive apparatus A employed in the speaker, a first coil C1 and a second coil C2 are wound around a bobbin 3 which is connected to a sound-producing cone (diaphragm) 12. Provided on the base portion of a frame 11 are a yoke 17 formed of a highly-permeable material and a magnet 18, both of which form a magnetic-field generating member. The first coil C1 is located in gap G1 defined between the N-pole surface of the magnet 18 and the yoke 17, while the second coil C2 is positioned in gap G2 between the S-pole surface of the magnet 18 and the yoke 17. The first and second coils C1 and C2 are wound in the directions opposite to each other (that is, if the first coil C1 is wound clockwise on the bobbin 3, then the second coil C2 is wound counterclockwise). The directions of magnetic fields across the coils C1 and C2 disposed in gaps G1 and G2, respectively, are opposite to each other. Accordingly, an electromagnetic driving force produced by a magnetic field generated across gap G1 and a voice current flowing in the first coil C1 act upon the bobbin 3 and the cone 12 in the same direction as an electromagnetic driving force produced by a magnetic field generated across gap G2 and a voice current flowing in the second coil C2.

A spacer S shown in FIGS. 1 to 4, which is used as an auxiliary member, is formed in a ring-like shape having a thickness d, and is made of a resin material. Formed in the spacer S is a hole 31 whose internal diameter r is substantially equal to or slightly smaller than external diameter R of the bobbin 3. The spacer S has a wire-passing portion 33 obtained by removing a portion of the material forming the spacer. Opposite to this wire-passing portion 33 is an incision 32 formed in the peripheral surface of the hole 31, whereby the hole 31 of the spacer S is easily widened for fitting onto the bobbin 3.

A pair of end portions 33*a* and 33*b* opposedly face each other across the wire-passing portion 33 and are each provided with a curved surface, as illustrated in FIG. 4B. In this embodiment edge surfaces 34*a* and 34*b* of the above-mentioned end portions 33*a* and 33*b*, respectively, are formed to be a circular-arc shape having a predetermined radius r1 which is equal to one-half of the distance d. At the connecting portions a to d, where the arc-like edge surfaces 34*a* and 34*b* join with the top and bottom surfaces 35*a* and 35*b* of the spacer S, the directions of the tangents of the arc-like edge surfaces 34*a* and 34*b* substantially coincide with the planar directions of the top and bottom surfaces 35*a* and 35*b* of the spacer S. Accordingly, the connecting portions a to d are smooth, free from the formation of abrupt level changes (steps and corners). Also, the arc-like edge surfaces 34*a* and 34*b* are continuously curved, such that they are free from linear segments and corners.

An explanation will now be given of a process for producing the first and second coils C1 and C2, the process forming a step of a method for manufacturing the magnetic drive apparatus A.

The hole 31 of the spacer S is mounted around the outer peripheral surface of the bobbin 3. A wire 4, such as a covered copper wire, is wound (starting from a first leading portion 10*a* shown in FIG. 1) around the outer peripheral surface of the bobbin 3 in the direction β, thus forming the inner layer of the first coil C1. The inner layer of the first coil C1 is formed by a single turn (layer) or a plurality of turns (layers) of windings in the radial direction of the bobbin 3. The first coil C1 is wound relative to the top surface 35*a* of the spacer S. A first end portion 10*b* positioned subsequent to the winding of the inner layer of the first coil C1 is curved generally in an arc shape along the edge surface 34*a*, that is, the arc surface, of the spacer S, and is guided downward in FIG. 1. A connecting portion 4*c* of the wire 4 extends from the first end portion 10*b* to a second leading portion 10*c* of the second coil C2, the connecting portion 4*c* forming a U-shape (substantially 180°) while being continuously curved in the same direction. After the U-shaped connecting portion 4*c,* the wire 4 is wound from the second leading portion 10*c* around the bobbin 3 in the direction α (the direction opposite to the direction in which the first coil C1 is wound), thus starting the formation of the second coil C2, which is formed relative to the bottom surface 35*b* of the spacer S.

The second coil C2 includes a plurality of turns (layers) of windings, and at a second end portion 10*d* the wire 4 is guided upward in FIG. 1 along the edge surface 34*b,* i.e., the arch surface, of the spacer S to form a second U-shaped connecting portion 4*f.* The second connecting portion 4*f* is continuously curved in the same direction along the edge surface 34*b* and makes a U-turn (substantially 180°) before reaching a third leading portion 10*e.* After the connecting portion 4*f,* the wire 4 is re-wound from the third leading portion 10*e* in the direction β on the above-described inner layer of the first coil C1, which has already been wound as discussed above. When the total number of turns of the inner layer of the first coil C1 and the turns in which the wire 4 is re-wound from the third leading portion 10*e* is equal to the total number of turns of the second coil C2, the wire 4 is guided from a third end portion 10*f,* thus completing the formation of the first coil C1.

Upon completion of the formation of the first and second coils C1 and C2, the spacer S is detached from the outer peripheral surface of the bobbin 3. The wire 4 forming the first and second coils C1 and C2 is further secured by use of an adhesive. Also, a material such as paper is wound around connecting portions 4*c* and 4*d* of the wire 4.

The bobbin 3 obtained by the formation of the first and second coils C1 and C2 as discussed above is connected to the inner portion 12*b* of the cone 12 for use in the speaker shown in FIG. 5. The coils C1 and C2 are inserted into gap G1 and G2, respectively, formed in the magnetic-field generating member. The magnetic drive apparatus A has thus been manufactured.

In the coil constituting the magnetic drive apparatus A produced by the above-described manufacturing process, as shown in FIGS. 1 and 2, the connecting portions 4*c* and 4*d* of the wire 4 bridging the first and second coils C1 and C2 are curved in only one direction, free from bent corners and linear segments. More specifically, the connecting portions 4*c* and 4*d* of the wire 4 are continuously curved in the respective portions from a to b and from c to d shown in FIG. 4B, guided by the smoothly-curved edge surfaces 34*a* and 34*b,* respectively. Accordingly, no stress concentration is imposed on any portion of the wire 4, which would otherwise occur in abruptly bent portions of the wire 4. Additionally, the spacer S is free from corners which may be formed in the connecting positions indicated by a and b between the edge surface 34*a* and the respective top and bottom surfaces 35*a* and 35*b,* and in the connecting portions indicated by c and d between the edge surface 34*b* and the respective top and bottom surfaces 35*a* and 35*b.* The edge surfaces 34*a* and 34*b* of the spacer S are also formed smooth, thus preventing damage to a coating on the wire 4.

Figure 8:
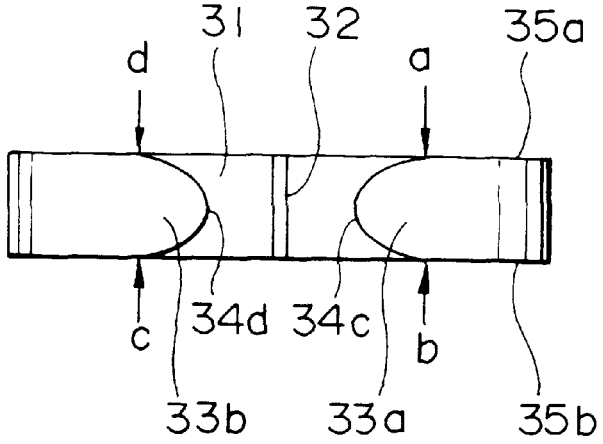
FIG. 8 is a front view of another spacer used for the winding operation of a coil forming the magnetic drive apparatus of the present invention.
Figure 9:
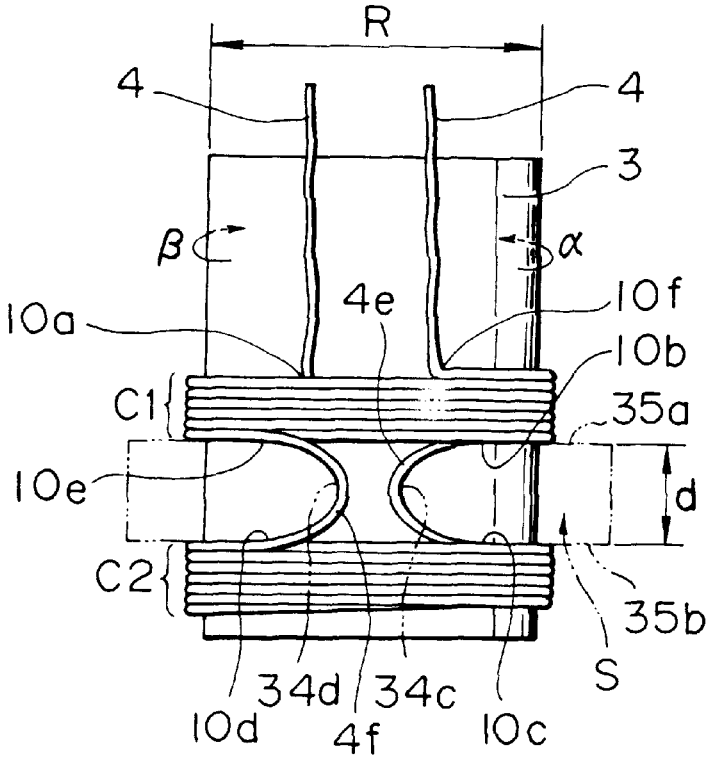
FIG. 9 is a front view of a bobbin and a coil produced using the spacer illustrated in FIG. 8.

This embodiment has been explained in the following fashion. With the use of the spacer S having a pair of end portions 33*a* and 33*b* whose edge surfaces 34*a* and 34*b* are formed in the arc-like shape having a predetermined radius r1, the connecting portions 4*c* and 4*d* of the wire 4 extending between the first and second coils C1 and C2 are continuously curved to be formed generally in an arch-like shape. However, the above-described arch-like shape is not exclusive. For example, as illustrated in FIG. 8, with the use of the spacer S whose edge surfaces 34*c* and 34*d* of a pair of end portions 33*a* and 33*b* are continuously curved to form generally in an elliptical shape, connecting portions 4*e* and 4*f* of the wire 4*d* extending over the first and second coils C1 and C2 may be constructed to be continuously curved to be formed generally in an elliptical shape, as shown in FIG. 9. Alternatively, the edge surfaces of the end portions 33*a* and 33*b* of the spacer S and the connecting portions of the wire 4 to be curved along the edge surfaces of the spacer S may be formed in a shape represented by other quadratic curves.

In the manner discussed above, the present invention is preferably constructed such that a wire is continuously curved between the first and second coils C1 and C2 in the same direction, free from a linear segment. A short linear segment may be formed along the axis on the edge surfaces 34*a* and 34*b* of the spacer S, in which case, smooth arc surfaces free from corners should be continuously formed adjacent to the linear segment. This prevents the formation of bent corners of the wire 4 between the coils C1 and C2, thus preventing the occurrence of stress concentration.

Also, in this embodiment the winding of the first coil C1 is restarted through the connecting portion 4*d* after the winding operation of the second coil C2 has been completed. However, upon completion of the winding of the second coil C2 subsequent to the first coil C1, the end of the wire may be guided to the exterior of the bobbin 3. Moreover, the coil structure may include more than two coil portions; that is, the coil structure may include three or four coil portions. In this case, curved connecting portions of wire should also be formed between the second and third coils, and the third and four coils, depending on the number of coil portions. Additionally, the magnetic drive apparatus of the present invention is applicable not only to a speaker, but also to other types of equipment that are adequate to convert an electrical current to mechanical force.

As will be clearly understood from the foregoing description, the present invention offers the following advantages.

The present invention prevents the generation of bent corners between the first and second coils C1 and C2 which are wound around a bobbin. More preferably, connecting portions of wire are formed between the first and second coils C1 and C2 in such a fashion that they are continuously curved in only one direction and make a U-turn of substantially 180°. Accordingly, no stress concentration is imposed on the wire, thus inhibiting a wire break. It is also possible to avoid a wire break caused by the heat generated by a high-output current. Further, a spacer having smooth curved surfaces is used to deform wire located at the connecting portions between the first and second coils. This prevents possible damage to wire caused by the spacer and also protects a coating from coming off of the wire.

What is claimed is:

1. A method for manufacturing a coil for a magnetic drive apparatus, comprising:

providing a tubular bobbin having an outer peripheral surface;

winding a wire around the outer peripheral surface of said bobbin to form a first coil;

bending the wire substantially 180 degrees without incurring formation of sharply bent corners of the wire; and winding the wire around the outer peripheral surface of said bobbin to form a second coil spaced apart from said first coil in the longitudinal direction of said bobbin;

wherein after forming said second coil the method includes the step of bending the wire from an end portion of said second coil such that the wire is free from bent corners, and further winding the wire on the first coil.

2. A method according to claim 1, wherein the step of bending the wire includes forming a continuous curve in the wire from an end portion of said first coil to a leading portion of said second coil.

3. A method according to claim 2, wherein the first and second coils are spaced apart a predetermined distance and the step of bending the wire includes forming the wire into a circular-arc shape with a radius substantially equal to one-half of the predetermined distance and extending from the end portion of said first coil to the leading portion of said second coil.

4. A method according to claim 2, wherein the step of bending the wire includes forming the wire into a continuously curved elliptical shape extending from the end portion of said first coil to the leading portion of said second coil.

5. A method for manufacturing a coil for a magnetic drive apparatus, comprising:

providing a tubular bobbin having an outer peripheral surface;

winding a wire around the outer peripheral surface of said bobbin to form a first coil;

bending the wire substantially 180 degrees without incurring formation of sharply bent corners of the wire; and winding the wire around the outer peripheral surface of said bobbin to form a second coil spaced apart from said first coil in the longitudinal direction of said bobbin;

wherein the step, of bending the wire includes forming a continuous curve in the wire from an end portion of said first coil to a leading portion of said second coil; and wherein after forming said second coil, the method further comprises bending the wire from an end portion of said second coil into a continuously curved segment such that the wire is free from a linear segment and is turned substantially 180 degrees, and further winding the wire on the first coil.

* * * * *